US009623312B2

(12) United States Patent
Hofmeyr

(10) Patent No.: US 9,623,312 B2
(45) Date of Patent: Apr. 18, 2017

(54) TENNIS TRAINING AIDS

(71) Applicant: TopspinPro Ltd., London (GB)

(72) Inventor: Phillip Reitz Hofmeyr, London (GB)

(73) Assignee: TopspinPro Ltd., London (GB)

( * ) Notice: Subject to any disclaimer, the term of this patent is extended or adjusted under 35 U.S.C. 154(b) by 0 days.

(21) Appl. No.: 14/763,336

(22) PCT Filed: Jan. 22, 2014

(86) PCT No.: PCT/EP2014/051183

§ 371 (c)(1),
(2) Date: Jul. 24, 2015

(87) PCT Pub. No.: WO2014/114655

PCT Pub. Date: Jul. 31, 2014

(65) Prior Publication Data

US 2015/0360112 A1 Dec. 17, 2015

(30) Foreign Application Priority Data

Jan. 24, 2013 (GB) ..... 1301242.2

(51) Int. Cl.

| | |
|---|---|
| ***A63B 69/00*** | (2006.01) |
| ***A63B 69/38*** | (2006.01) |
| *A63B 63/06* | (2006.01) |

(52) U.S. Cl.

CPC ..... *A63B 69/385* (2013.01); *A63B 69/0073* (2013.01); *A63B 69/38* (2013.01); *A63B 63/06* (2013.01); *A63B 69/0002* (2013.01); *A63B 69/0075* (2013.01); *A63B 69/0079* (2013.01); *A63B 69/0084* (2013.01); *A63B 69/0091* (2013.01); *A63B 2225/09* (2013.01); *A63B 2225/093* (2013.01)

(58) Field of Classification Search

CPC . A63B 69/38; A63B 69/0073; A63B 69/0075; A63B 69/20; A63B 69/0002; A63B 69/0084; A63B 69/0091; A63B 69/385; A63B 2225/09; A63B 2225/093; A63B 63/06

USPC ..... 473/461, 422, 423–430, 451, 459, 462

See application file for complete search history.

(56) References Cited

U.S. PATENT DOCUMENTS 2,578,313 A * 12/1951 Moseley ..... A63B 69/0091 473/426

2,652,250 A 9/1953 Alder et al.

(Continued)

FOREIGN PATENT DOCUMENTS

DE 8427527 1/1985

FR 2600899 A1 * 1/1988 ..... A63B 69/38

(Continued)

*Primary Examiner* — Mitra Aryanpour

(74) *Attorney, Agent, or Firm* — Gable Gotwals

(57) ABSTRACT

A tennis teaching aid comprises a stand and a ball (10) and a guide (12) mounted on the stand for rotation about an axis. The guide (12) extends around the ball (10) and defines a planar guide plane that is parallel to but spaced from a required path of a tennis racquet to hit the ball (10) with topspin. The majority of the ball (10) projects above the guide plane for contact with a tennis racquet so that a correct contact with the ball (10) is achieved when the racquet moves parallel to, but not in contact with, the guide (12) and the ball (10) is spinning about its rotational axis.

12 Claims, 4 Drawing Sheets

(56) References Cited

Figure 1C:
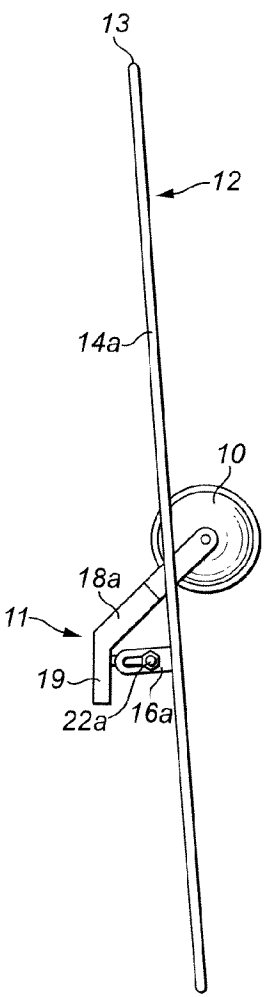

U.S. PATENT DOCUMENTS 4,105,203 A * 8/1978 Cho ..... A63B 69/0091 473/429
4,417,730 A * 11/1983 Weiner ..... A63B 69/0091 473/426
4,460,172 A * 7/1984 Hogan ..... A63B 69/0091 473/426
4,735,413 A * 4/1988 Yamanouchi ..... A63B 69/0084 473/426
5,222,732 A * 6/1993 Robey ..... A63B 69/38 473/459
5,393,050 A 2/1995 Lloyd
5,607,377 A * 3/1997 Wilkinson ..... A63B 5/11 482/27
5,728,031 A * 3/1998 Honeycutt ..... A61H 23/06 482/148
6,056,653 A * 5/2000 Boldin ..... A63B 69/38 473/461
6,296,582 B1 * 10/2001 Minniear ..... A63B 69/0002 473/422
6,514,161 B1 * 2/2003 Minniear ..... A63B 69/0002 473/423
7,115,052 B2 * 10/2006 Wardle ..... A63B 69/38 473/423
7,217,202 B2 * 5/2007 Troxell ..... A63B 69/0002 473/422
7,435,195 B1 * 10/2008 Calderon ..... A63B 69/0075 473/459
8,333,671 B1 * 12/2012 Wheelbarger ..... A63B 24/0062 473/417
9,308,427 B2 * 4/2016 Garner ..... A63B 43/00 473/449
2011/0165970 A1 * 7/2011 Lesniewicz ..... A63B 69/38 473/426

FOREIGN PATENT DOCUMENTS

FR 2609405 A1 * 7/1988 ..... A63B 69/385
GB 479561 2/1938
WO 2009/012105 1/2009
WO WO 2014/114655 A1 * 7/2014 ..... A63B 69/00

* cited by examiner

TENNIS TRAINING AIDS

CROSS-REFERENCE TO RELATED APPLICATIONS

This application is the United States National Phase of Patent Application No. PCT/EP2014/051183 filed 22 Jan. 2014, which claims priority to British Patent Application No. 1301242.2 filed 24 Jan. 2013, each of which is incorporated herein by reference.

BACKGROUND OF THE INVENTION

The invention relates to tennis teaching aids.

The game of tennis requires a player to make a variety of strokes with the racquet. Some of the most effective strokes are topspin strokes but many players find difficulty in hitting strokes with topspin. Topspin strokes require the racquet, at the moment the ball is hit, to be travelling not only in the direction the ball is desired to travel off the racquet but also to be travelling at an angle to that path inclined towards the court surface so that the ball leaves the racquet spinning in the same direction that it is moving. This causes the ball to dip towards the court surface more quickly that would otherwise be the case and so gives the player a greater margin of error as well as producing a shot that is more difficult to return.

In order to impart such topspin, therefore, a player needs to be capable of maintaining the racquet at such an angle before, as and after the ball is hit that topspin is imparted to the ball. This is commonly done by the player practicing topspin shots using balls projected towards the payer by a machine, another payer or a coach.

According to the invention, there is provided a tennis teaching aid comprising a stand, a ball mounted on the stand for rotation about an axis and a guide extending around the ball and defining a racquet angle plane that is parallel to but spaced from a required plane angle of a tennis racquet to hit and rotate the ball with topspin, the majority of the ball being above the guide plane for contact with a tennis racquet in a topspin stroke without the racquet contacting the guide.

In this way, a player can practice hitting the stationary ball, attempting to keep the racquet angle such that the racquet moves parallel to, but spaced from, the guide surface and so that the racquet brushes over the surface of the exposed ball to impart spin to the ball. If the racquet is incorrectly orientated, the racquet will touch the guide surface, so indicating to the player that the stroke has been incorrectly executed. If the racquet is too close to the guide surface or slides over the guide surface, the edge of the racquet will strike the ball at or below the axis of the ball and no or little spin will be imparted. Having the majority of the ball above the plane of the guide surface allows the player to hit the ball with confidence, knowing that, unless the stroke is very awry, the racquet will not touch the guide surface.

Figure 1B:
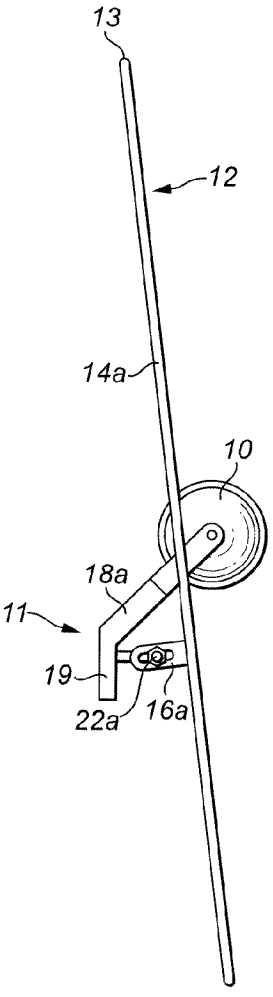
Figure 1A:
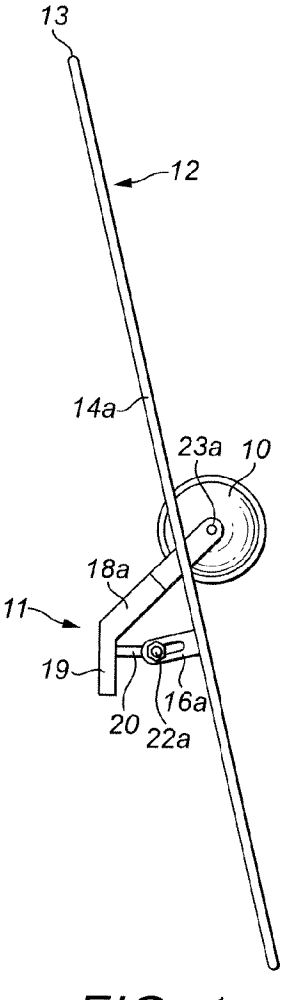
Figure 4:
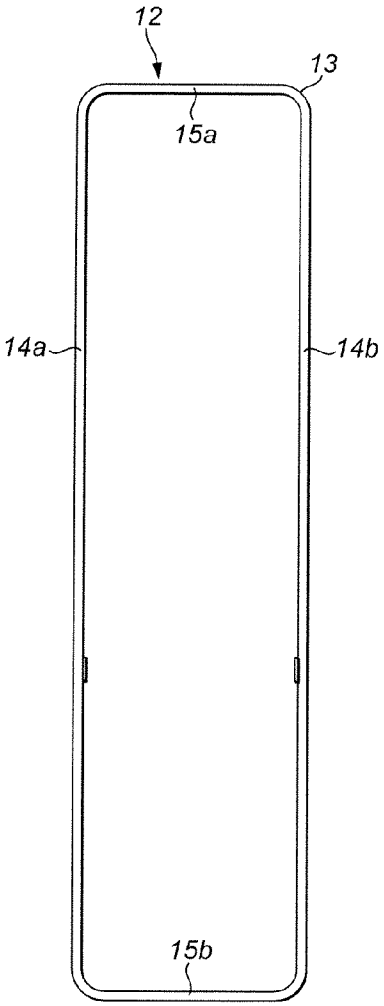
Figure 2:
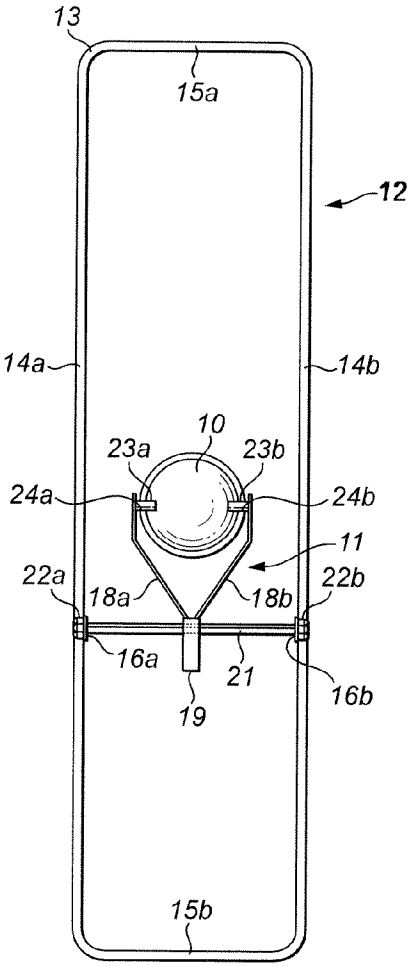
Figure 5:
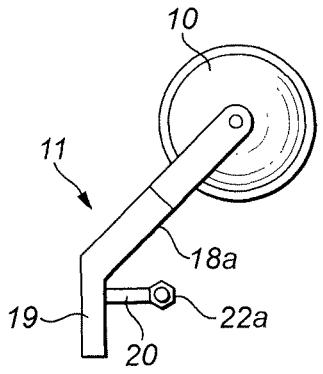
Figure 6:
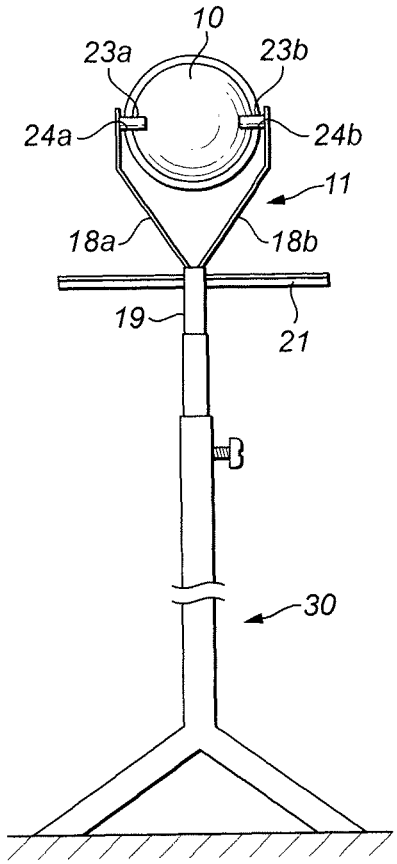
Figure 7:
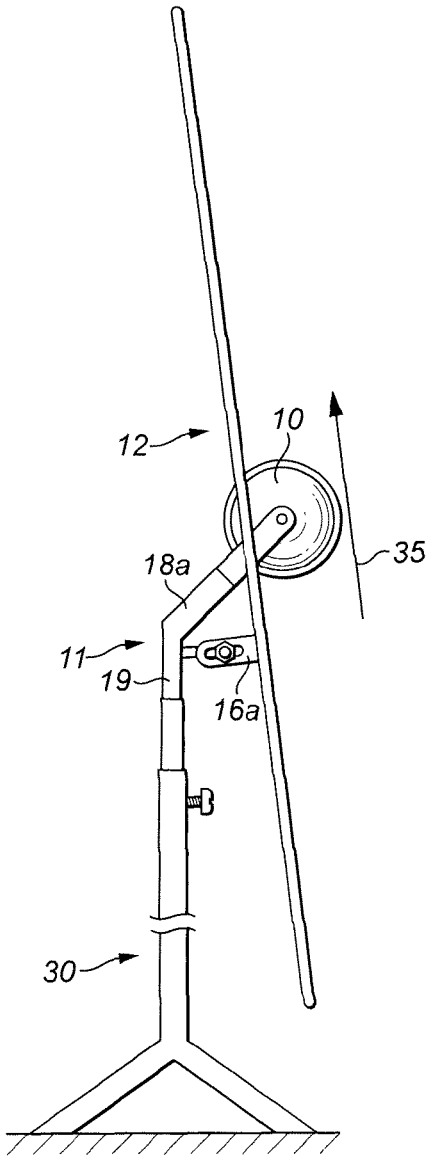

The following is a more detailed description of an embodiment of the invention, by way of example, reference being made to the accompanying drawings, in which:

FIGS. 1*a*, 1*b* and 1*c* are respective side elevations of a tennis teaching aid including a ball, a ball mounting and a guide, with a stand of the aid omitted, the Figures showing respective different angles of orientation of the aid, FIG. 2 is a front elevation of the aid of FIGS. 1*a*, 1*b* and 1*c*, FIG. 3 is a side elevation of the guide of FIGS. 1*a*, 1*b*, 1*c* and 2, FIG. 4 is a front elevation of the guide of FIGS. 1*a*, 1*b*, 1*c*, 2 and 3, FIG. 5 is a side elevation of the ball and ball mounting of FIGS. 1*a*, 1*b*, 1*c* and 2, FIG. 6 is a front elevation of the ball and ball mounting of FIG. 5 carried on a stand, and FIG. 7 is a similar view to FIG. 1*a* but including the stand and showing the angle of a racquet in a topspin stroke.

Referring to the Figures, the tennis aid comprises a tennis ball 10, a ball mounting 11 and a guide 12. The tennis ball 10, ball mounting 11 and guide 12 are carried, in a manner described in more detail below, on a stand 30 of conventional type that may allow for adjustment of the height of the guide 12 above the ground.

The guide 12, which may be formed of metal or plastics, includes a thin rectangular member 13 having parallel first and second longer sides 14*a*, 14*b* spaced by parallel first and second shorter ends 15*a*, 15*b*. The member 13 lies in a single plane and, as described below, is connected to the stand 30 and can be rotated about a horizontal axis parallel to the ends 15*a*, 15*b* with the second end 15*b* closer to the ground than the first end 15*a* so that the angle of the plane of the guide 12 relative to the ground can be adjusted as required—see FIGS. 1*a*, 1*b* and 1*c*, which show three possible angles. In this way, the member 13 of the guide 12 defines a guide plane.

Figure 3:
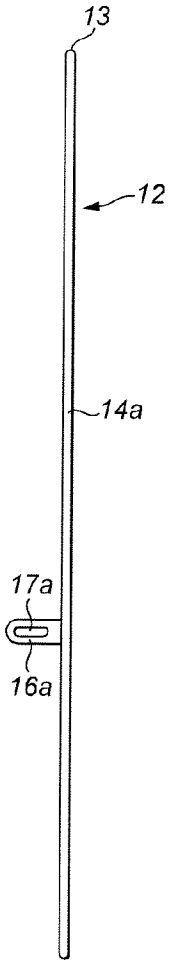

The longer sides 14*a*, 14*b* carry respective lugs 16*a*, 16*b* that project to one side of the plane of the member 13 and are formed with respective slots, one of which is seen in FIG. 3 at 17*a*. These are for connection to the ball mounting 11, as described below.

The ball mounting 11 is Y-shaped with two diverging arms 18*a*, 18*b* and a leg 19. As seen in FIGS. 1*a*, 1*b*, 1*c* and 5, the arms 18*a*, 18*b* are angled relative to the leg 19. A bar 20 projects from the leg 19 beneath the angled arms 18*a*, 18*b* and connects to a spindle 21 that extends normal to the leg and projects to either side of the width of the arms 18*a*, 18*b* (see FIGS. 2 and 6). The ends of the spindle 21 are threaded. The free ends of the arms 18*a*, 18*b* are formed with respective pegs 23*a*, 23*b* that extend into respective diametrically opposed holes 24*a*, 24*b* in the tennis ball 10. The ball 10 is thus rotatable on the mounting 11 about a horizontal axis.

The lower end of the leg 19 is a screw fit into the top of the stand 30 (see FIG. 6). Once mounted on the stand, the ends of the spindle 21 are inserted through the slots 17*a* in the lugs 16*a*, 16*b* on the member 13 and fixed by nuts 22*a*, 22*b*. In this way, the guide 12 is carried on the ball mounting 11 so that, as seen in FIGS. 1*a*, 1*b*, and 1*c*, the majority of the ball 10 projects above the plane of the guide 12 and can be pivotally adjusted relative to the guide 12 so that the amount by which the majority of the ball 10 projects above the guide 12 can be adjusted, as seen in FIGS. 1*a*, 1*b* and 1*c*.

In use, the stand 30 (see FIGS. 6 and 7) is erected so that the guide 12 is at a desired height and the angle of the guide 12 adjusted to represent the required racquet angle to hit a top spin stroke. For a normal backhand or forehand stroke, the angle may be between 70° and 85°. The amount by which the majority of the ball 10 projects above the plane of the guide 12 and the angle of orientation of the ball 10 can be adjusted as required by releasing the nuts 22*a*, 22*b* and moving the slots 17*a* along the spindle 21 to alter the projection and/or rotating the guide 12 about spindle 21 to alter the angle. The ability to change the angle of orientation allows a choice between a more aggressive vertical topspin or a shallower shot with less spin. Adjustment of the amount by which the majority of the ball is exposed allows a greater exposure to beginners and a lesser exposure for more experienced players. A person then attempts to hit the ball 10 with a tennis racquet trying to move the racquet in a line across the guide 12 with a racquet angle that is parallel to, but spaced from, the plane of the guide 12 (as shown by the arrow 35 in FIG. 7) while hitting the ball 10. If successful, the racquet will not touch the guide 12 (as seen in FIG. 7) and the ball 10 will spin in the mounting 11 with topspin. If unsuccessful, the racquet will touch the guide 12 and so indicate to the player that the stroke has not been performed correctly. By repetition, the player will learn to hit the ball 10 consistently without hitting the guide 12 and so perfect maintaining the racquet at the correct angle to hit a topspin stroke. This is important because, when a movement is repeated over time, a long-term muscle memory is created for that task, eventually allowing it to be performed without conscious effort. This process decreases the need for attention and creates maximum efficiency within the motor and memory systems.

Of course, particularly with more proficient players, a top spin shot will be hit with the player in motion—both forwards and/or rotationally—but there is still an absolute requirement for a correct racquet angle that can be met using the trainer described above with reference to the drawings.

The aid can be used both for forehand and backhand strokes and may be adapted for other spin shots such as serves and sliced backhand strokes.

It is important that the majority of the ball 10 is above the guide plane to allow a proper contact between the ball 10 and a request and to allow a person using the side to be confident of hitting the ball 10 without touching the guide 12. In practice, a person using the aid will always tend to keep the racquet from touching the guide 12 since the majority of the ball is exposed above the guide 12 and so the guide 12 serves a more psychological function than a structural function. People are usually proficient in judging how to keep a racquet head parallel to an adjacent plane. The guide 12 may extend 30-50 cm (11.8-19.7 inches) above and below the ball giving an overall length of 60 cm (23.6 inches) to 100 cm (39.4 inches).

The guide 12 need not be formed by the rectangular member 13. The member 13 could have any desired shape for example circular or oval. The shape need not be a closed shape. It need not be formed by a thin member 13; it could be formed by a plate or by a shaped member with a planar rim that lies in a single plane. The guide 12 could have a portion remote from the ball that defines a curved path parallel to a desired curved path for a racquet prior to reaching the zone of the ball 10.

In the embodiment described above with reference to the drawings, the mounting of the ball 10 is fixed relative to the guide 12. The two diverging arms 18*a*, 18*b* and the leg 19 mounting the ball 10 may, however, be resiliently mounted for movement relative to the guide 12 so that, when the ball is struck, it moves into the plane of the guide 12 against the spring load, with the spring loading subsequently returning mounting and the ball 10 to the starting position shown in the drawings before the next stroke.

The invention claimed is:

1. A tennis teaching aid comprising:

a stand;

a ball mounting connected to the stand;

a ball mounted on the ball mounting for rotation about an axis; and a repositionable guide rotatably mounted on the ball mounting and extending around the ball and defining a racquet angle guide plane that exposes a majority of the ball above the racquet angle guide plane and is parallel to but spaced from a required racquet angle of a tennis racquet to hit and rotate the ball with topspin.

2. The aid according to claim 1 wherein the guide plane is planar.

3. The aid according to claim 1 wherein the axis is a horizontal axis.

4. The aid according to claim 1, wherein an amount by which the majority of the ball is exposed above the racquet angle guide plane is adjustable.

5. The aid according to claim 1, wherein the guide comprises a thin member forming a closed shape lying in a single plane.

6. The aid according to claim 5 wherein the thin member is in the shape of a rectangle.

7. The aid according to claim 1, wherein the height of the stand is adjustable.

8. The aid according to claim 1, wherein the repositionable guide is rotatable about a horizontal axis to adjust an angle of the racquet angle guide plane relative to the ground.

9. The aid according to claim 4, wherein the height of the stand is adjustable.

10. The aid according to claim 4, wherein the repositionable guide is rotatable about a horizontal axis to adjust an angle of the racquet angle guide plane relative to the ground.

11. The aid according to claim 9, wherein the repositionable guide is rotatable about a horizontal axis to adjust an angle of the racquet angle guide plane relative to the ground.

12. A tennis teaching aid comprising:

an adjustable height stand;

a ball mounting connected to the adjustable height stand;

a ball mounted on the ball mounting for rotation about an axis; and a repositionable guide rotatably mounted on the ball mounting for rotation relative to the ground and extending around the ball and defining a racquet angle guide plane relative to the ball that exposes a majority of the ball above the racquet angle guide plane and is parallel to but spaced from a required racquet angle of a tennis racquet to hit and rotate the ball with topspin.

* * * * *